US008950848B2

(12) United States Patent
Tamai

(10) Patent No.: US 8,950,848 B2
(45) Date of Patent: Feb. 10, 2015

(54) PRINTING APPARATUS AND MANUFACTURING METHOD OF PRINTED MATTER

(71) Applicant: Seiko Epson Corporation, Tokyo (JP)

(72) Inventor: Takashi Tamai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/847,421

(22) Filed: Mar. 19, 2013

(65) Prior Publication Data

US 2013/0278675 A1 Oct. 24, 2013

(30) Foreign Application Priority Data

Apr. 20, 2012 (JP) ..... 2012-096324

(51) Int. Cl.

| | |
|---|---|
| ***B41J 23/00*** | (2006.01) |
| ***B41J 2/07*** | (2006.01) |
| ***B41J 25/00*** | (2006.01) |
| ***B41J 19/14*** | (2006.01) |
| ***B41J 19/20*** | (2006.01) |

(52) U.S. Cl.

CPC *B41J 2/07* (2013.01); *B41J 25/001* (2013.01); *B41J 19/142* (2013.01); *B41J 19/202* (2013.01)

USPC ..... 347/39; 347/37

(58) Field of Classification Search

USPC ..... 347/39, 37

See application file for complete search history.

(56) References Cited

U.S. PATENT DOCUMENTS

| | | | | |
|---|---|---|---|---|
| 7,914,112 | B2 * | 3/2011 | Hayashi et al. | 347/39 |
| 2001/0028375 | A1 * | 10/2001 | Ohtani et al. | 347/37 |

FOREIGN PATENT DOCUMENTS

| | | | |
|---|---|---|---|
| JP | 07-047695 | A | 2/1995 |
| JP | 07-148945 | A | 6/1995 |
| JP | 2000-343687 | A | 12/2000 |
| JP | 2001-038888 | A | 2/2001 |
| JP | 2007-261037 | A | 10/2007 |

* cited by examiner

*Primary Examiner* — Stephen Meier
*Assistant Examiner* — Alexander D Shenderov
(74) *Attorney, Agent, or Firm* — Maschoff Brennan

(57) ABSTRACT

A printing apparatus that performs printing on a printing medium, comprising an ejecting unit that reciprocates in a main scanning direction which is a width direction of the printing medium, ejecting a liquid onto the printing medium when moving at least in a forward direction of the main scanning direction; and a control unit that controls an operation of the printing apparatus, wherein in one movement of the ejecting unit in the forward direction, the control unit includes a specific operation mode which causes the ejecting unit to move to a predetermined distance in addition to a width of an image when the width of the image to be printed on the printing medium is less than a predetermined value.

6 Claims, 3 Drawing Sheets

FIRST OPERATION MODE
(WIDTH OF IMAGE ≥ PREDETERMINED VALUE)

SPECIFIC OPERATION MODE (SECOND OPERATION MODE)
(WIDTH OF IMAGE < PREDETERMINED VALUE)

PRINTING APPARATUS AND MANUFACTURING METHOD OF PRINTED MATTER

BACKGROUND

1. Technical Field

The present invention relates to a printing apparatus and a manufacturing method of a printed matter.

2. Related Art

As a printer that is an example of a printing apparatus, a serial printer has been known which moves a printing head in a main scanning direction that is a width direction of a printing medium and performs printing (for example, JP-A-7-47695). In the serial printer, when an ink which is hard to be dried so as to use a heater to dry is ejected from the printing head onto the printing medium, there is a case where the below-described disadvantage occurs. That is, when a subsequent ink is ejected at a position adjacent to the previously ejected ink before the ink which is ejected from the head onto the printing medium is dried, there is a case where the adjacent inks are mixed with each other. When the adjacent inks are mixed with each other, there is a case where a printed image is degraded in quality.

In order to suppress the degradation of the printed image in quality, for example, a technology of JP-A-7-47695 causes a carriage to stand by for a predetermined time from when forward or rearward recording scanning is completed until the next recording scanning In addition, for example, according to a technology of JP-A-2007-261037, the number of main scanning with respect to one line in the main scanning direction is changed depending on a width of a printing area, so that a distance is available between dots formed by ejecting the inks during one main scanning in order to suppress the degradation of the printed image in quality.

However, the technology to suppress the degradation of the printed image needs more improvement in the technology in which printing is performed using the serial printer. For example, the technology of JP-A-7-47695 may cause various disadvantages due to a printing operation. For example, since the carriage is caused to stand by during the printing, a user often feels uncomfortable when performing the printing operation. In addition, there is a case where a malfunction occurs in respective members configuring the printing apparatus due to a degree of an acceleration operation or deceleration operation when the carriage is caused to reciprocate. In addition, for example, in the technology of JP-A-2007-261037, even though the distance is available between the dots formed by ejecting the inks during one main scanning, when the width of the printed image is narrow and the ink is landed onto the printing medium, there is a case where the ink is landed onto the adjacent area in a state where a sufficient drying time cannot be ensured, and there still is a possibility that the inks are mixed with each other.

The various problems described above commonly occur in the technology in which a liquid is ejected onto the printing medium by moving an ejecting unit without limiting to the printer in which the printing is performed using the ink which is hard to be dried.

SUMMARY

An advantage of some aspects of the invention is to provide a technology that decreases a disadvantage due to a printing operation and a possibility that liquids landed on a printing medium are mixed with each other in the technology that performs the printing in such a way that an ejecting unit is moved to eject a liquid onto the printing medium.

The invention can be realized in the following forms or application examples.

APPLICATION EXAMPLE 1

According to Application Example 1, there is provided a printing apparatus that performs printing on a printing medium, which includes an ejecting unit that reciprocates in a main scanning direction which is a width direction of the printing medium, ejecting a liquid onto the printing medium when moving at least in a forward direction of the main scanning direction, and a control unit that controls an operation of the printing apparatus. In one movement of the ejecting unit in the forward direction, the control unit includes a specific operation mode which causes the ejecting unit to move to a predetermined distance in addition to a width of an image when the width of the image to be printed on the printing medium is less than a predetermined value.

In this case, when the width of the image printed on the printing medium is less than the predetermined value, the ejecting unit is moved to a predetermined distance in addition to the width of the image. Therefore, even when the width of the image is less than the predetermined value, the liquid is landed onto the printing medium and a period of the time can be prolonged until the liquid is landed onto the adjacent region. Therefore, a possibility that the liquids may be mixed with each other on the printing medium can be decreased. In addition, the ejecting unit is moved to the predetermined distance in addition to the width of the image. For example, this allows the acceleration or the deceleration to be decreased during the printing operation. Therefore, it is possible to decrease a load applied to a member configuring the printing apparatus during the printing operation, and to decrease a possibility that the printing apparatus may have a malfunction.

APPLICATION EXAMPLE 2

In the printing apparatus according to Application Example 1, in the specific operation mode, as the number of paths increases which is the number where the ejecting unit is caused to reciprocate so as to print a predetermined area of the image to be printed on the printing medium, the predetermined distance may be set so as to monotonically decrease.

In this case, it is possible to decrease the possibility that the printing time from a printing start to a printing end varies due to the different number of paths.

APPLICATION EXAMPLE 3

In the printing apparatus according to Application Example 1, in the specific operation mode when the image is a monochromatic image, as the image becomes denser, the predetermined distance may be set so as to monotonically decrease accordingly.

Depending on the printing apparatus, as the image is denser, the number of the paths is increased and thus, there is a case where the printing is performed to leave s space between liquids ejected by one scanning In this case, as the image is denser, it is possible to decrease the possibility that the printing time varies from the printing start to the printing end due to a density in the printed image by monotonically decreasing the predetermined distance. Herein, a degree (density value) of the density in the printed image can be measured by a colorimeter.

APPLICATION EXAMPLE 4

According to Application Example 4, there is provided a printing apparatus that performs printing on a printing medium, which includes an ejecting unit that reciprocates in a main scanning direction which is a width direction of the printing medium, ejecting a liquid onto the printing medium when moving at least in a forward direction of the main scanning direction, and a control unit that controls an operation of the printing apparatus. In one movement of the ejecting unit in the forward direction, the control unit includes a first operation mode in which a moving distance D of the ejecting unit may be set to be expressed by the following formula (1), and a second operation mode in which a moving distance D of the ejecting unit is set to be expressed by the following formula (2). The control unit performs the printing in the first operation when the width of the image to be printed on the printing medium is a predetermined value or more, and performs the printing in the second operation mode when the width of the image is less than the predetermined value.

$$D=G+\alpha \quad \text{(formula 1)}$$

$$D=G+\beta \quad \text{(formula 2)}$$

Here, G is the width of the image to be printed on the printing medium.

$$\beta>\alpha\geq 0$$

In this case, when the width of the image printed on the printing medium is less than the predetermined value, the printing is performed by moving the ejecting unit to a distance longer than the width of the image. Therefore, even when the width of the image is less than the predetermined value, the liquid is landed onto the printing medium and then the period of time can be prolonged until the liquid is landed onto the adjacent region. Therefore, it is possible to decrease the possibility that the liquids landed on the printing medium may be mixed with each other. In addition, the ejecting unit is moved to the distance longer than the width of the image, for example, and thus it is possible to decrease the acceleration or the deceleration of the ejecting unit during the printing operation. Therefore, it is possible to decrease the load applied to the member configuring the printing apparatus during the printing operation and to decrease the possibility that the printing apparatus may have a malfunction.

In addition, the invention can be realized by various embodiment, and in addition to the configuration as the above-described printing apparatus, can be achieved by the forms such as a manufacturing method of a printed matter, a computer program which realizes a function of the apparatus or the method, and a recording medium which records the computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order.

A. Embodiment

B. Modification Example

A. Embodiment

A-1. Configuration of Printing Apparatus

Figure 1:
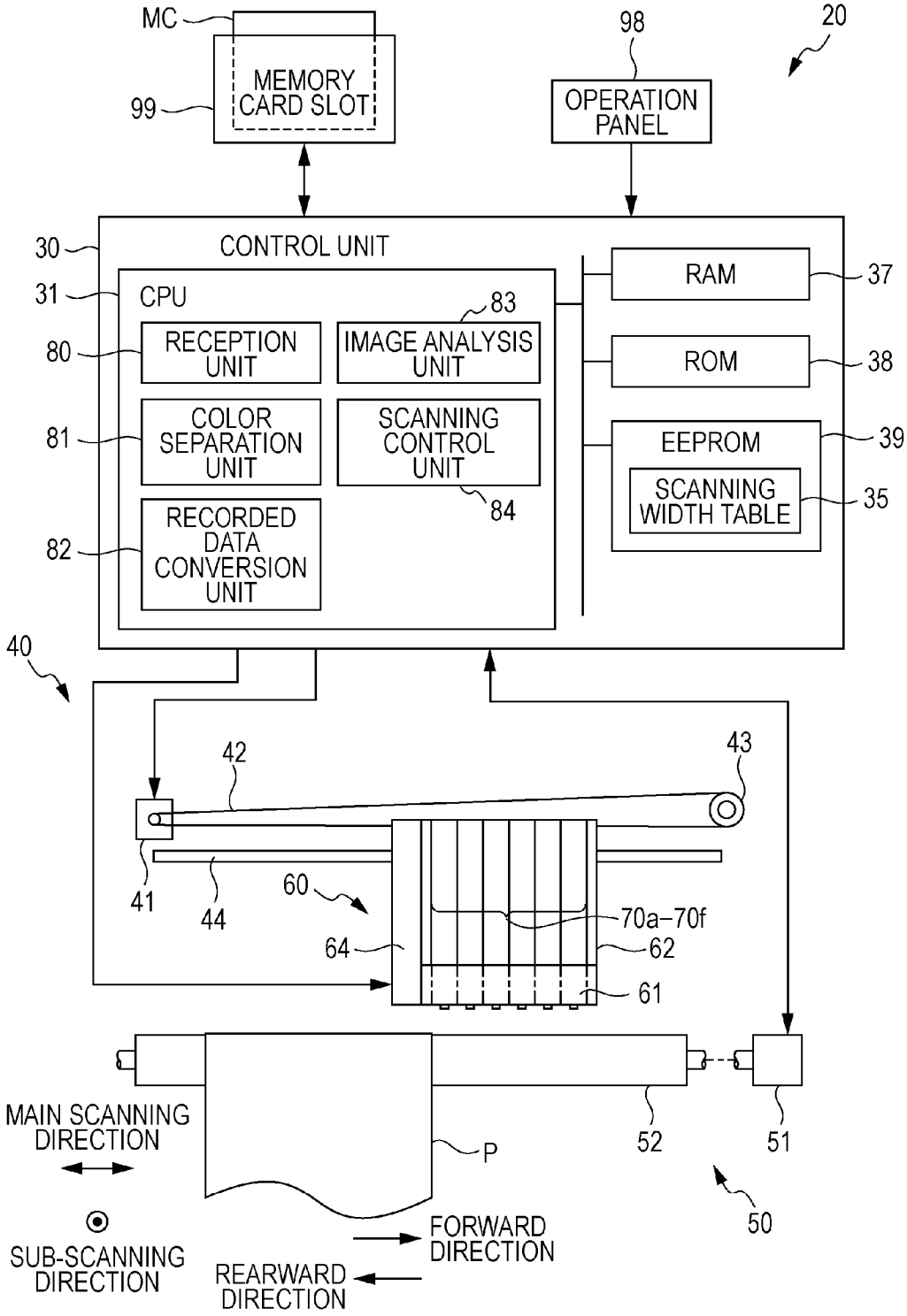
FIG. 1 is an explanatory diagram illustrating a schematic configuration of a printer in an embodiment of the invention.

FIG. 1 is an explanatory diagram illustrating a schematic configuration of a printer 20 according to an embodiment of the invention. The printer 20 as a printing apparatus according to the embodiment is an ink jet printer which forms ink dots on a printing medium by ejecting an ink from a plurality of nozzles to form an image on the printing medium.

As illustrated in FIG. 1, the printer 20 includes a printing head unit 60, a head transportation mechanism 40, a sheet transportation mechanism 50, an operation panel 98, a memory card slot 99, and a control unit 30.

The printing head unit 60 mounts a printing head 61 as an ejecting unit that ejects the ink onto the printing medium. The head transportation mechanism 40 reciprocates the printing head unit 60 along the direction (the main scanning direction) parallel to an axis of a platen 52. Herein, the direction parallel to the axis of the platen 52 is the width direction of a sheet P as the printing medium. The sheet transportation mechanism 50 transports the sheet P in the direction (the sub-scanning direction) intersecting the main scanning direction. The operation panel 98 receives various instructions or settings relative to the printing. The memory card slot 99 is configured to be connectable to a memory card MC. The control unit 30 controls an operation of the printer 20. In the embodiment, the printer 20 performs unidirectional printing which ejects the ink only in case where the printing head unit 60 moves (scans) in the forward direction.

The sheet transportation mechanism 50 has a motor 51. A rotation of the motor 51 is transported to a sheet transportation roller (not illustrated) via a gear train (not illustrated), and the sheet P is transported along the sub-scanning direction by the rotation of the sheet transportation roller.

The head transportation mechanism 40 has a motor 41, a pulley 43 that tightly stretches an endless drive belt 42 with the motor 41, and a shaft 44 that slidably retains the printing head unit 60 parallel to the axis of the platen 52. The rotation of the motor 41 is transported to the printing head unit 60 via the drive belt 42 and thus the printing head unit 60 reciprocates along the shaft 44.

A holder 62 of the printing head unit 60 is provided with a plurality of the ink cartridges 70 (70*a* to 70*f*) as a liquid receptacle which accommodates the ink of respective predetermined colors (for example, cyan (C), light cyan (Lc), magenta (M), light magenta (Lm), yellow (Y), black (K)). In addition, in the following description, the plurality of ink cartridges 70*a* to 70*f* are simply referred to as the ink cartridge 70. In the embodiment, the ink cartridge 70 is mounted on the holder 62 from above in the gravity direction. The ink accommodated in the ink cartridge 70 mounted on the holder 62 is supplied to the printing head 61. The printing head 61 has a plurality of nozzles that ejects the ink. For each color, the plurality of the nozzles are disposed to form a column in the sub-scanning direction.

In addition, the printing head unit 60 is provided with a heater 64 as a drying mechanism. Air heated for the sheet P is blown to the sheet P from the heater 64. Therefore, the ink landed onto the sheet P is promptly dried.

In the control unit 30, a CPU 31, a ROM 38, a RAM 37 and an EEPROM 39 are connected to each other via bus. The control unit 30 deploys and performs a program stored in the ROM 38 or the EEPROM 39 on the RAM 37 and thus an overall operation of the printer 20 is controlled. In addition, the control unit 30 also functions as a reception unit 80, a color separation unit 81, a recorded data conversion unit 82, an image analysis unit 83 and a scanning control unit 84.

A scanning width table 35 is recorded in the EEPROM 60. The scanning width (a moving distance) of the printing head unit 60 is recorded in the scanning width table 35 according to properties (for example, a width of the image) of the image printed on the sheet P based on image data. The scanning width table 35 will be described below in detail.

The reception unit 80 acquires the image data stored in the memory card MC, and converts the image data into bitmap type data (for example, RGB data). The color separation unit 81 converts the bitmap data which is converted by the reception unit 80 into data (CMYK data) corresponding to an ink color of the printer 20. The recorded data conversion unit 82 performs a halftone processing with respect to ink color data which is converted by the color separation unit 81, and converts the processed data into recording data (data that specifies an ejection/non-ejection or ejection amount of the ink).

The image analysis unit 83 calculates the width of the image printed on the sheet P for each raster based on the ink color data which is converted by the color separation unit 81. Herein, as the width of the image of each raster, a distance between dots of both ends among dots formed in each raster can be used. In addition, the image analysis unit 83 calculates a degree of the density in the image printed on the sheet P based on the ink color data which is converted by the color separation unit 81. Herein, the raster is an arrangement of each dot in the main scanning direction. In addition, the degree of the density (a density value) is represented by a gradation value in the image data.

The scanning control unit 84 selects a printing mode from any one of the first operation mode and the second operation mode, and performs the printing based on an analysis result of the image data performed by the image analysis unit 83. In addition, the first and second operation modes will be described below in detail.

Figure 2A:
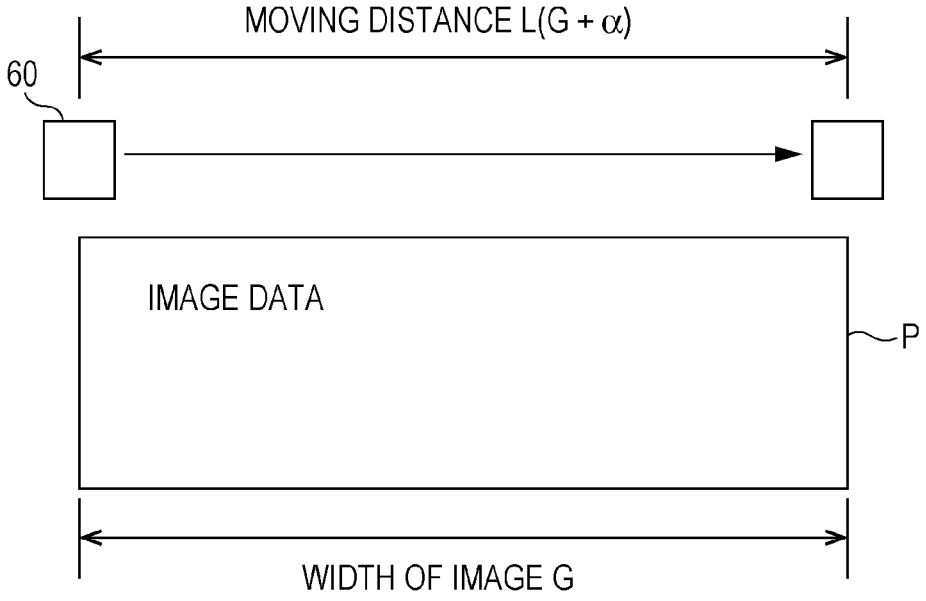
FIGS. 2A and 2B are views illustrating a printing mode.
Figure 2B:
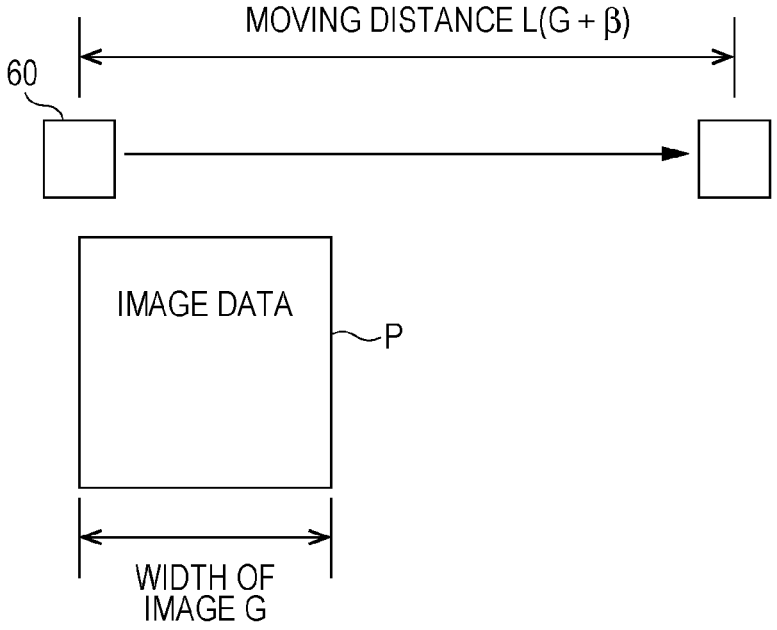

FIGS. 2A and 2B are views illustrating the printing mode performed by the control unit 30 of the printer 20. FIG. 2A is a view illustrating the first operation mode, and FIG. 2B is a view illustrating the second operation mode. As illustrated in FIGS. 2A and 2B, the printer 20 includes the first operation mode and the second operation mode which differ in a scanning specification of the printing head unit 60 as a printing execution mode. The control unit 30 performs the printing in the first operation mode when the width of the image (referred to as "an width of an image G") printed on the sheet P using the image data receiving by the control unit 30 is a predetermined value or more, and performs the printing in the second operation mode when the width of the image G is less than the predetermined value. Herein, as the width of the image G which becomes an index for determining the first or the second operation mode, for example, the width of the image formed on the sheet P by moving the printing head unit 60 once in the forward direction may be used, and a minimum value of the width of the image in each raster among all images printed on the single sheet P may be used. In the embodiment, as the width of the image G, the width of the image formed on the sheet P by moving the printing head unit 60 once in the forward direction is used.

The predetermined value of the width of the image G for selecting either the first or the second operation mode can be set according to a type of the printing medium (for example, presence or absence of an ink accommodation layer) and a type of the ink. For example, the predetermined value may be set in a range that prevents the adjacent inks from being mixed with each other when the printing head unit 60 is allowed to move to the same distance as the width of the image G.

As illustrated in FIG. 2A, if the printing head 60 moves once in the forward direction, the first operation mode causes the printing head unit 60 to move to a distance (G+α) when the width of the image G is a predetermined value or more. Herein, α is a value greater than or equal to 0, and α is 0 in the embodiment. That is, in the embodiment, in the first operation mode, the printing is performed in such a manner that the printing head unit 60 is caused to move to only the width of the image G.

As illustrated in FIG. 2B, the second operation mode (a specific operation mode) causes the printing head unit 60 to move to a predetermined distance β in addition to the width of the image G when the width of the image G is less than a predetermined width G. Herein, a relationship of β>α is met. In addition, when the control unit 30 causes the printing head unit 60 to move to the predetermined distance β, the ejecting operation of the ink is not performed from the printing head 61.

Figure 3:
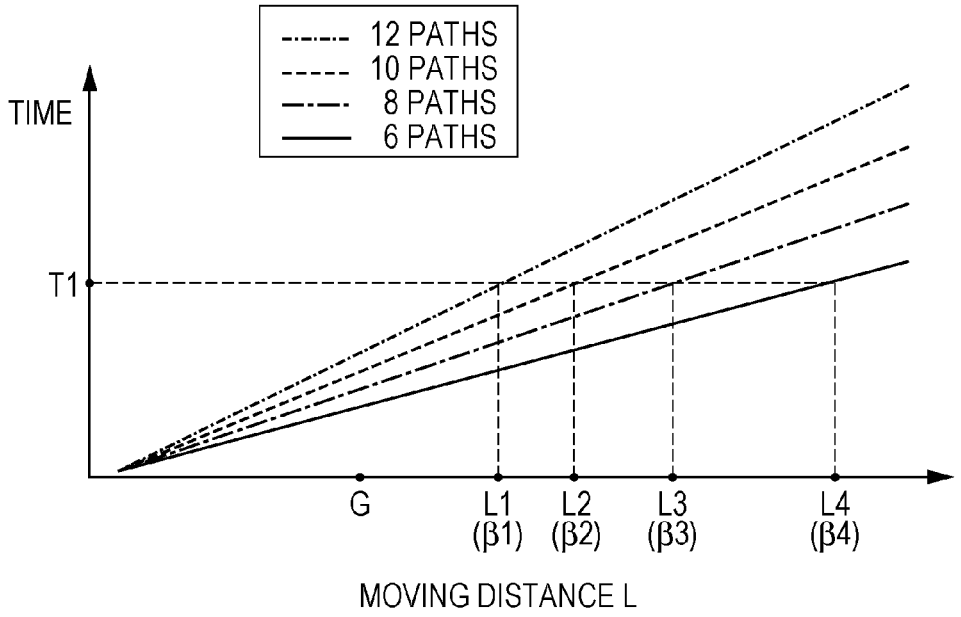
FIG. 3 is a view illustrating a scanning width table.

FIG. 3 is a view illustrating a scanning width table 35. The control unit 30 of the printer 20 uses data stored in the scanning width table 35 to perform the second operation mode. As the number of the paths increases, the scanning width table 35 is set such that the predetermined distance β (=the scanning width (a moving distance) L—the width of the image G) monotonically decreases. In the embodiment, the moving distance L is set such that the printing time for printing the predetermined area is constant regardless of the number of the paths. For example, as illustrated in FIG. 3, when the printing time for printing the predetermined area of the width of the image G is assumed as a time T1, the moving distance L is set to the time T1 in each path. In the embodiment, for example, the following data is stored in the scanning width table 35. That is, the data having the moving distance L1 (a predetermined distance β1) when the number of the paths is 12, a moving distance L2 (a predetermined distance β2) when the number of the paths is 10, a moving distance L3 (a predetermined distance β3) when the number of the paths is 8, and a moving distance L4 (a predetermined distance β4) when the number of the paths is 6 is stored in the scanning width table 35. Here, the relationship of β1<β2<β3<β4 is met.

In addition, "monotonically decreasing" indicates a relationship wherein predetermined distance β continuously decreases without increasing relative to an increase in the number of the paths, although the number of the paths within a certain range, may correspond to the same predetermined distance β in the scanning width table 35. "The number of the paths" is the number where the printing head unit 60 is caused to reciprocate in order to print the predetermined area within the image printed on the sheet P, and one path is counted as once in the forward scanning or the rearward scanning In the embodiment, "the predetermined area" is a region having a predetermined width in the sub-scanning direction, and is equivalent to a length of a nozzle row of the printing head 61.

A-2. Effect

In the embodiment, when the width of the image G is less than a predetermined value, the printing head unit 60 is caused to move to the predetermined distance □ in addition to the width of the image G. Therefore, unlike the configurations currently known in the art, even when printing the image data of the width of the image G less than the predetermined value which would previously result in a high possibility that the adjacent inks may be maxed with each other, the embodiments described herein provide a configuration where when the ink is landed on the sheet P it is possible to prolong the time (referred to as "an elapsed time") until the ink is landed on the adjacent region. . . .

In addition, in the above-described embodiment, as the number of the paths is increased, the predetermined distance β is set to be decreased during the second operation mode. Therefore, it is possible to decrease the variations in the printing time due to the different number of the paths.

B. Modification

In spite of the embodiment of the invention described above, the invention is not limited to such an embodiment, and may adopt various configurations without being departed from the scope thereof. For example, the following modifications are available.

B-1. First Modification

Figure 4:
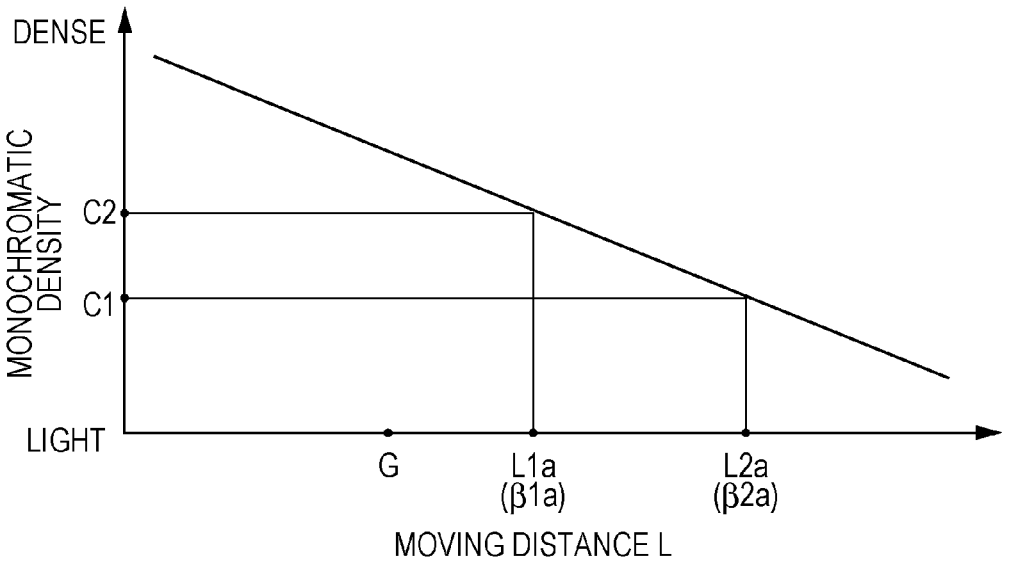
FIG. 4 is a view illustrating other example of the scanning width table.

FIG. 4 is a view illustrating another example of the scanning width table 35. In the above-described embodiment, the scanning width table 35 is provided based on the number of the paths and the moving distance L (FIG. 3), but may be provided based on other factors. For example, as illustrated in FIG. 4, if an image printed on the sheet P is a monochromatic image, as the printed image becomes denser, the scanning width table 35 may be provided in order to decrease the predetermined distance β monotonically. Herein, the density of the image used for determining the predetermined distance β, for example, can be determined by comparison with the maximum density value in the predetermined area of the images printed on the sheet P. For example, in FIG. 4, in the predetermined area of the images printed on the sheet P, the scanning width tables 35 is set so that the moving distance L of the image in a case of the maximum density value C2 is shorter than that of the image in a case of the maximum density value C1. For example, the following data may be stored in the scanning width table 35. That is, the data such as the moving distance L1*a* (the predetermined distance B1*a*) in a case of the density value C 1, and the moving distance L2*a* (the predetermined distance B2*a*) in a case of the density value C2 may be stored in the scanning width table 35. In addition, the density of the monochromatic image is represented by a gradation value in the image data. The scanning control unit 84 uses the moving distance L corresponding to the maximum gradation value for each predetermined area calculated by the image analysis unit 83 in the scanning width table 35 to perform the printing operation in the second operation mode.

For example, as the printing method of the printer 20, as the printed image becomes denser, the number of the paths may be increased and thus the inks ejected during the scanning operation are spaced further apart during printing. That is, as the image becomes denser by decreasing the predetermined distance β monotonically and increasing the number of paths, it is possible to decrease the variations in the printing time due to the density of the printed image.

B-2. Second Modification

In the embodiment, although the printer 20 performs the unidirectional printing, the above-described embodiment may be adopted in a case where the printer performs the bidirectional printing ejecting the ink during the scanning in the forward direction and the scanning in the rearward direction of the printing head unit 60. Therefore, the same effect as the above-described embodiment may be obtained. For example, it is possible to prolong the period of time from when the printing is performed on the sheet P through one scanning of the printing head unit 60 until when the printing is performed on the sheet P through the next scanning Therefore, it is possible to decrease a mixture of the inks with each other landed on the sheet P and to suppress the degradation of the printing image in quality.

The entire disclosure of Japanese Patent Application No. 2012-96324, filed Apr. 20, 2012 is expressly incorporated by reference herein.

What is claimed is:

1. A printing apparatus that performs printing on a printing medium, comprising:

an ejecting unit that reciprocates in a main scanning direction which is a width direction of the printing medium, ejecting a liquid onto the printing medium when moving at least in a forward direction of the main scanning direction; and a control unit that controls an operation of the printing apparatus, wherein when the width of the image to be printed on the printing medium is less than a predetermined value, the control unit includes a specific operation mode which causes the ejecting unit to move a predetermined distance in addition to a width of an image in a path wherein the ejecting unit moves along the main scanning direction, and wherein when the width of the image to be printed on the printing medium is equal to or greater the predetermined value, the ejecting unit moves the width of the image in the path as the image is printed on the printing medium without moving the ejecting unit any additional distance in the main scanning direction.

2. The printing apparatus according to claim 1, wherein in the specific operation mode, as the number of paths increases which is the number of times the ejecting unit is caused to reciprocate in the main scanning direction so as to print a predetermined area of the image to be printed on the printing medium, the predetermined distance that the ejecting unit moves in addition to the width of the image in a single path is set so as to monotonically decrease.

3. The printing apparatus according to claim 1, wherein in the specific operation mode when the image is a monochromatic image, as the image becomes denser, the predetermined distance is set so as to monotonically decrease.

4. A printing apparatus that performs printing on a printing medium, comprising:

an ejecting unit that reciprocates in a main scanning direction which is a width direction of the printing medium, ejecting a liquid onto the printing medium when moving at least in a forward direction of the main scanning direction; and a control unit that controls an operation of the printing apparatus, wherein the control unit includes a first operation mode in which a moving distance D of the ejecting unit which is traveled in a single path as ejecting unit performs a single pass in the forward direction of the main scanning direction is set to be expressed by the following formula (1), and a second operation mode in which the moving distance D of the ejecting unit is set to be expressed by the following formula (2), and wherein the control unit performs the printing in the first operation mode when the width of the image to be printed on the printing medium is a predetermined value or more, and performs the printing in the second operation mode when the width of the image is less than the predetermined value $$D=G+\alpha \quad \text{(formula 1)}$$

$$D=G+\beta \quad \text{(formula 2)}$$

wherein, G is the width of the image to be printed on the printing medium, $\alpha$ is the first additional distance that the ejecting units travels in a single pass in a path beyond the width of the image to be printed on the printing medium in the first operation mode, and $\beta$ is the second additional distance that the ejecting unit travels in a single pass in a path beyond the width of the image to be printed on the printing medium in the second operation mode, and, $$\beta>\alpha\geq 0.$$

5. A manufacturing method of a printed matter using a printing apparatus including an ejecting unit that reciprocates in a main scanning direction which is a width direction of the printing medium, ejecting a liquid onto the printing medium when moving at least in a forward direction of the main scanning direction, wherein the ejecting unit is caused to move to a predetermined distance in addition to a width of an image when the width of the image to be printed on the printing medium is less than a predetermined value, wherein the ejecting unit is caused to move the width of the image when the width of the image to be printed on the printing medium is equal to or greater than the predetermined value without moving the ejecting unit any additional distance in the main scanning direction.

6. A manufacturing method of a printed matter using a printing apparatus including an ejecting unit that reciprocates in the main scanning direction which is a width direction of the printing medium, ejecting a liquid onto the printing medium when moving at least in a forward direction of the main scanning direction, wherein printing is performed so as to meet the following formulas (1) and (2), and $$D=G+\alpha \quad \text{(formula 1)}$$

$$D=G+\beta \quad \text{(formula 2)}$$

wherein, G is the width of the image to be printed on the printing medium, $\alpha$ is the first additional distance that the ejecting unit travels in a single pass in a path beyond the width of the image to be printed on the printing medium in a first operation mode, and $\beta$ is the second additional distance that the ejecting unit travels in a single pass in a path beyond the width of the image to be printed on the printing medium in a second operation mode and $$\beta>\alpha, \text{ and } \alpha=0.$$

* * * * *